United States Patent [19]

Wolf et al.

[11] Patent Number: 4,917,180

[45] Date of Patent: Apr. 17, 1990

[54] HEAT EXCHANGER WITH LAMINATED HEADER AND TANK AND METHOD OF MANUFACTURE

[75] Inventors: Peter G. Wolf, Tonawanda; George K. Snyder, Lockport, both of N.Y.

[73] Assignee: General Motors Corporation, Detroit, Mich.

[21] Appl. No.: 329,172

[22] Filed: Mar. 27, 1989

[51] Int. Cl.[4] ..... F28F 1/02

[52] U.S. Cl. ..... 165/150; 165/175; 29/890.043

[58] Field of Search ..... 165/173, 175, 150, 176; 29/157.3 R, 157.3 A, 157.3 C; 128/44.3

[56] References Cited

U.S. PATENT DOCUMENTS

| | | | |
|---|---|---|---|
| 2,028,456 | 1/1936 | Karmazin | 165/150 |
| 2,064,036 | 12/1936 | Sandberg | 165/150 X |
| 4,600,051 | 7/1986 | Wehrman | 165/173 X |

*Primary Examiner*—Alan Cohan

*Attorney, Agent, or Firm*—Ronald L. Phillips

[57] ABSTRACT

A tube and center heat exchanger has header and tank assemblies formed of just two plates stacked and bonded together: One plate has apertures for receiving the tube ends, and the second plate is formed with a plurality of tank defining indentations in an interface thereof that interconnect selected ones of the tube ends to thereby connect all the tubes to define a serpentine flow path through the heat exchanger. The header and tank plates are stamped from flat sheet stock of braze clad aluminum, the necessary perforations, clinch tabs and indentations are formed and the plates are stacked and clinched into header and tank assemblies. The tube and center elements are assembled and the tube ends are inserted into the header and tank assemblies. The whole heat exchanger is then brazed to form the bonding between the plates as well as the other elements.

7 Claims, 4 Drawing Sheets

HEAT EXCHANGER WITH LAMINATED HEADER AND TANK AND METHOD OF MANUFACTURE

FIELD OF THE INVENTION

This invention relates to heat exchangers and the method of manufacture thereof and particularly with respect to heat exchangers having laminated headers and tanks.

BACKGROUND OF THE INVENTION

Tube and center heat exchangers commonly have a plurality of parallel flat extruded tubes coupled at each end to a header and tank assembly and fins or air centers between the tubes to facilitate efficient heat transfer to the surrounding air. The header and tank assemblies generally comprise a header plate with tube receiving apertures and a tank secured to the plate to supply working fluid to and receive fluid from the tubes. The tubes are brazed or otherwise bonded to the plates to assure leak free joints. The tank is also assembled to the plate in a leak free manner. The U.S. Pat. No. 3,310,869 to La Porte et al reveals this type of heat exchanger. There, each header plate and tank is integrally formed of a single sheet of material curved into a flat sided cylinder and brazed or crimped along a seam. The U.S. Pat. No. 3,675,710 to Ristow shows a condenser having tubes connected to header and tank assemblies fabricated from sheet stock welded or brazed together. Individual partitions welded crosswise between the interior walls of the tank control the fluid flow path in the condenser. The placing of the partitions determines the number of passes of fluid across the condenser core and the number of tubes in each pass.

Structural improvements in such condensers or other heat exchangers are desired to enhance the ease of manufacture and reduce complexity while maintaining or improving durability and reliability. Design goals include improved burst pressure and low tooling cost. Design flexibility is also important to allow selection of the number of passes etc. with a minimal change in the structure and the manufacturing process.

SUMMARY OF THE INVENTION

It is therefore an object of the invention to provide an improved heat exchanger structure which is easy to fabricate and is flexible in design.

It is another object to provide an improved method of manufacture of a heat exchanger.

The invention is carried out by a heat exchanger having a plurality of parallel tubes for carrying a working fluid and a header and tank assembly at each end of the tubes for directing the working fluid through the tubes in a desired flow path, each header and tank assembly comprising; a flat header plate apertured for receiving an end of each of the plurality of tubes and serving as one side of a passage means and a tank plate aligned with and clinched and brazed to the header plate and serving as a second side of the passage means, and wherein the tank plate has indentations formed in its interface defining individual tanks connecting two or more of the tube ends and thereby their respective tubes as parallel flow passages in a plurality of passes across the heat exchanger.

The invention is also carried out by the method of manufacturing a heat exchanger having a pair of header and tank assemblies connected by a plurality of parallel tubes comprising the steps of: for each header, stamping a header plate and a tank plate from flat stock including forming tube receiving apertures in the header plate and tanks in the tank plate, stacking the header plate and the tank plate to form passage means therebetween, mechanically securing the stacked plates into a header and tank assembly and connecting a plurality of tubes to the header and tank assemblies by inserting tube ends into the apertures of the header plates; assembling corrugated fins between the tubes; and brazing the whole assembly to bond the parts at each joint.

BRIEF DESCRIPTION OF THE DRAWINGS

The above and other advantages of the invention will become more apparent from the following description taken in conjunction with the accompanying drawings wherein like references refer to like parts and wherein.

DESCRIPTION OF THE PREFERRED EMBODIMENT

While the ensuing description is directed to a condenser for an automotive air conditioner, it will be understood by those skilled in the art that the invention clearly applies to other heat exchangers as well.

Figure 1:
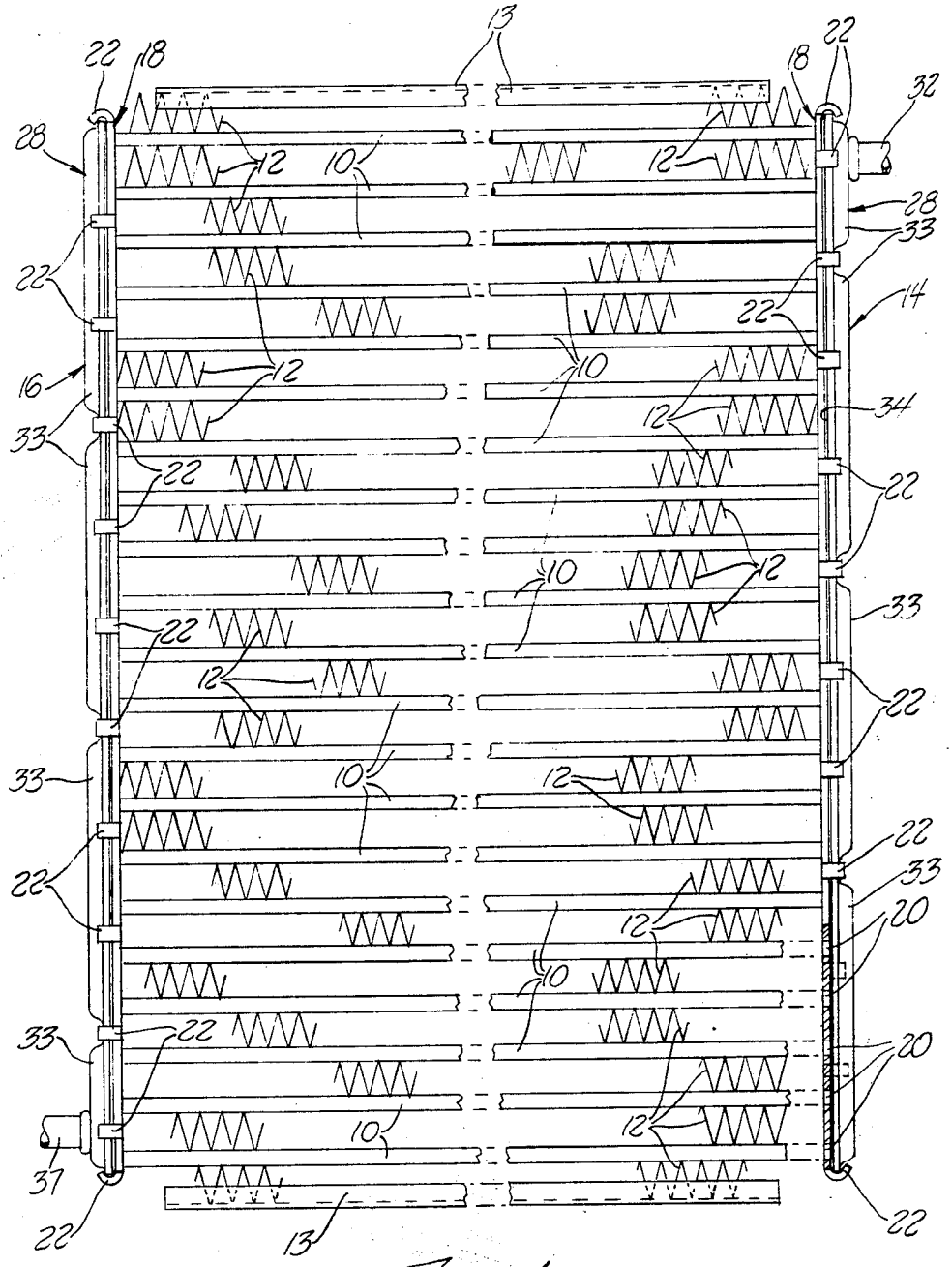
FIG. 1 is a front view of a condenser having laminated header and tank assemblies according to the invention.

Referring to FIG. 1, the condenser thereshown comprises a plurality of flat extruded tubes 10 arranged in parallel configuration and between which are mounted air centers 12 for thermal coupling of the tubes with the ambient air. Reinforcement side plates 13 engage the outermost air centers 12 and the ends of the tubes 10 are connected to header and tank assemblies 14 and 16.

Figure 2:
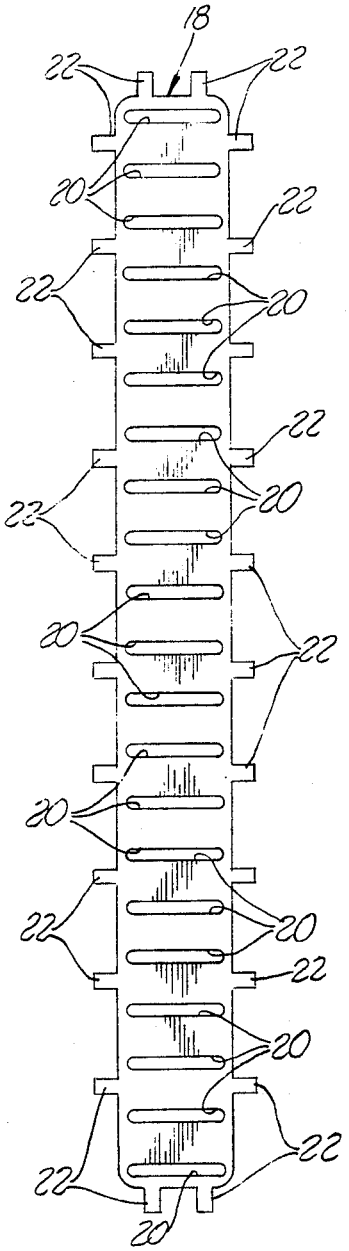
FIG. 2 is a side view of a header plate of one of the laminated header and tank assemblies of FIG. 1.
Figure 3:
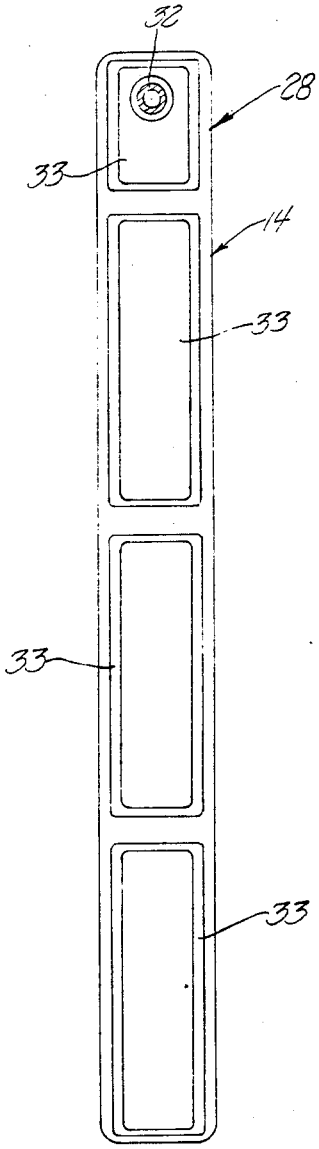
FIG. 3 is a side view of a tank plate of one of the laminated header and tank assemblies of FIG. 1.
Figure 4:
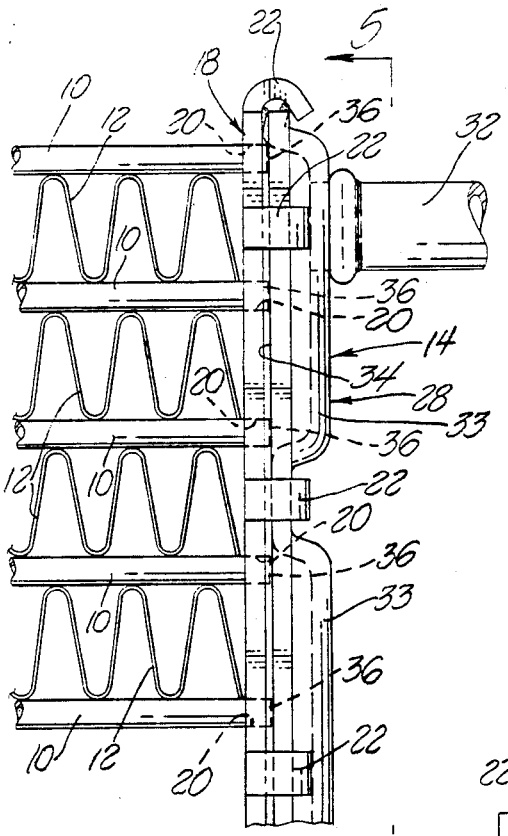
FIG. 4 is an enlargement of the upper right hand end of the laminated header and tank assembly in FIG. 1.
Figure 5:
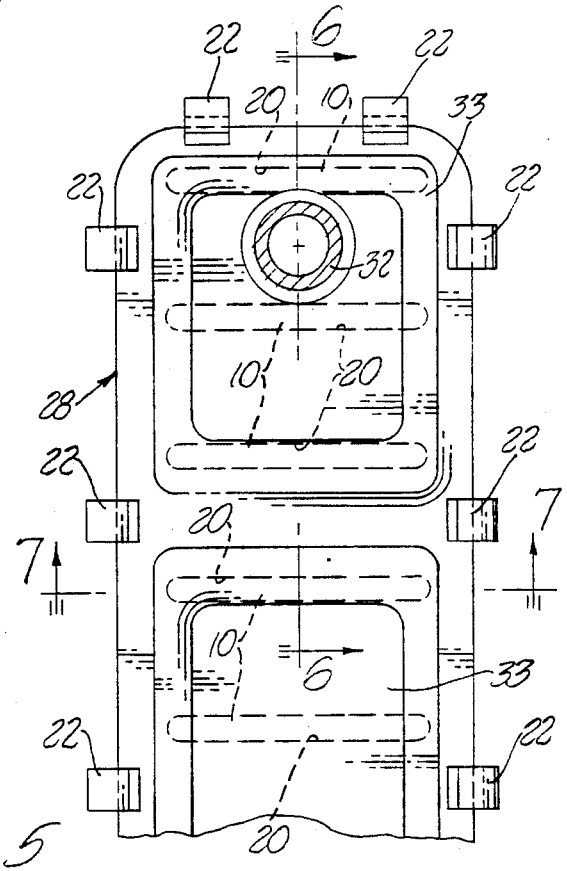
FIG. 5 is a view taken on the line 5—5 in FIG. 4.
Figure 6:
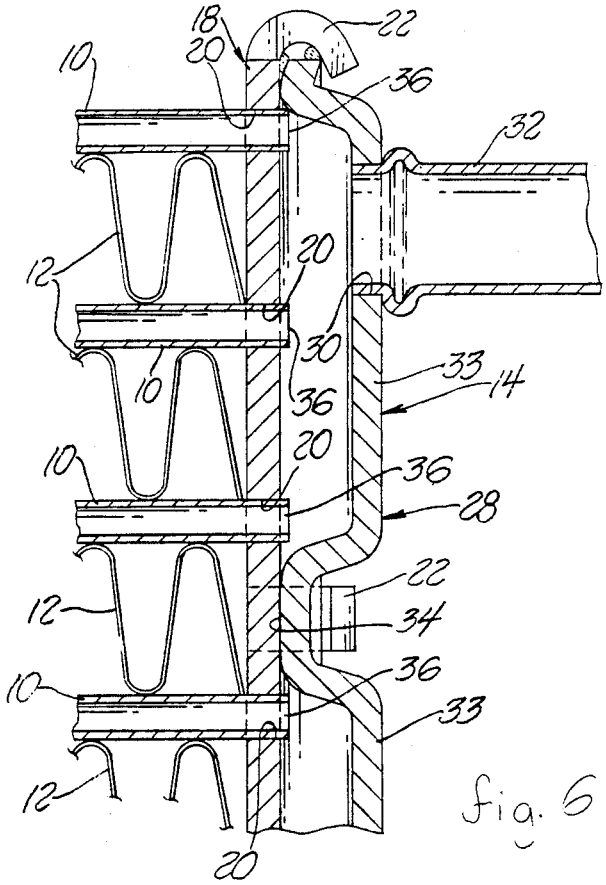
FIG. 6 is a further enlarged view taken on the line 6-6 in FIG. 5.
Figure 7:
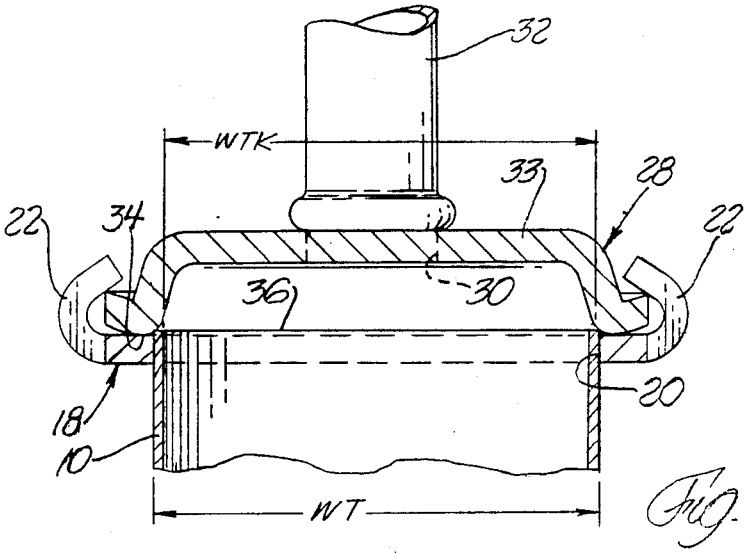
FIG. 7 is a further enlarged view taken on the line 7—7 in FIG. 5.

The header and tank assembly 14 is formed of only two laminated plates (shown in FIGS. 2 and 3): a header plate 18 having both apertures 20 for receiving the tubes 10 and clinch tabs 22 for assembly and a tank plate or cap 28 having both an inlet port 30 for receiving an inlet tube 32 and a plurality of integral tanks 33 for interconnecting certain ones of the tubes at their ends. The plates are preferably thick, e.g., 3.2 mm, so that secure connections can be made with the tubes 10 and the tube 32 to achieve high pressure and strength capability. The tanks 33 are defined by indentations formed in the interface 34 of the tank plate and in this adaptation are rectangularly shaped and sized to interconnect various numbers of the tubes 10 thereby to define parallel flow passes in a serpentine flow path through the condenser (see FIGS. 1, 4, 5 and 6). Moreover, as seen in FIG. 7, the width WTK of the tanks 33 at the interface of the tank plate is slightly less than the flat side width WT of the tubes 10 so that the tank plate serves as a stop at the opposite end edges 36 of each tube end for proper positioning of the tubes 10 upon assembly of the tubes and headers.

The header and tank assembly 16 is the same as the header and tank assembly 14 except that an outlet tube 37 is positioned at the opposite end of the condenser from the inlet and the tanks 33 in assembly 16 are staggered relative to those in assembly 14 as seen in FIG. 1 so that they cooperatively define the desired serpentine flow path through the condenser. In the embodiment shown, there are twenty-one tubes with the tanks 33 interconnecting them in a serpentine path of seven parallel passes of three tubes each. Alternatively, the tanks 33 can be sized so that only a single tube per pass is used and, of course, if an even number of passes is chosen the outlet and inlet ports will be in the same tank plate. Moreover, the tanks 33 may be of different size to connect different numbers of the tube ends in the passes. Thus the characteristics of different condenser models can be very simply designed by the selection of the integral tanks 33 in the tank plates thereby giving flexibility in design.

Conventional aluminum heat exchanger materials are employed so that conventional brazing can be used. All the parts comprise a base material of aluminum 3003 and at least the header plate 18 and the tank plate 28 and the centers 12 are clad with aluminum 4343 which serves as brazing material. Alternatively, other alloy combinations appropriate t the intended brazing process may be used.

The manufacture of the condenser comprises extruding the flat tubes 10 and cutting them to size, and forming the zigzag air centers 12 from 0.0045 to 0.006 inch thick stock. The tubes 10 and centers 12 and the reinforced side plates 13 are assembled and mechanically held together to form a core subassembly. The plates 18 and 28 are stamped from flat aluminum sheet stock about 3.2 mm thick with the various perforations 20 and clinch tabs 22 on plate 18 and indentations 33 on plate 28 formed at various steps in the stamping. The plates may be stamped from the same stock when the same thickness and braze cladding are desired. The resulting interfaces of the plates are flat and make intimate contact with one another hen assembled. The header plate 18 and tank plate 28 are stacked and then mechanically joined into a subassembly by clinching the tabs 22 about the margin of the tank plate at evenly spaced points therealong. Then the header and tank assemblies are coupled to the core subassembly by inserting the tube ends into the apertures 20 in the respective header plates. The inlet and outlet tubes 32, 37 are inserted into the corresponding ports. All the tubes 10 abut the interface of the respective tank plate 28 to prevent the intrusion of a tube into a tank 33 at one end and out of the header plate 18 at the opposite tube end. The entire condenser is brazed in one operation by a conventional brazing process comprising spraying the condenser with a fluoride flux and heating it to 1100 degrees F. in a brazing furnace. Other joining processes such as vacuum brazing may be used.

It will thus be seen that according to the invention an improved heat exchanger structure using two-piece laminated header and tank assemblies and the method of making it provide a flexible design which has high pressure capability and is easy to manufacture. Variations from the described embodiment may occur within the teaching of the invention.

The embodiments of the invention in which an exclusive property or privilege is claimed are defined as follows:

1. A heat exchanger having a plurality of parallel tubes for carrying a working fluid and a header and tank assembly at each end of the tubes for directing the working fluid through the tubes in a desired flow path, each header and tank assembly comprising:

a flat header plate apertured for receiving an end of each of the tubes and serving as one side of a passage means, a tank plate aligned with and contacting the header plate and serving as a second and only other side of said passage means, said tank plate having a plurality of indentations in an interface thereof forming individual integral tanks connecting a plurality of the tube ends, and said tanks having a width at the interface of the respective tank plate narrower than the width of the tubes so as to prevent insertion of the tubes into the tanks at one tube end and out of the header plate at an opposite tube end.

2. The invention as defined in claim 1 wherein the tanks in the two header and tank assemblies are staggered to yield a serpentine flow path through the heat exchanger.

3. The invention as defined in claim 1 wherein the tanks are of different size to connect different numbers of the tube ends.

4. The method of manufacturing a heat exchanger having a pair of header and tank assemblies connected by a plurality of parallel tubes comprising the steps of:

for each header and tank assembly, stamping a flat header plate and a tank plate from flat sheet stock including forming tube receiving apertures in the header plate and a plurality of tank defining indentations in an interface of the tank plate wherein the width of the tank defining indentations at the interface of the tank plate are formed narrower than the width of the tubes so that upon insertion of the tubes into the apertures the tank plate prevents tube insertion into the tanks defining indentations at one tube end and out of the header plate at an opposite tube end, stacking the header plate against the interface of the tank plate to form passage means between the two plates for connecting selected ones of the tubes at their ends, connecting a plurality of tubes to the header and tank assemblies by inserting their ends into the apertures of the header plates, assembling air centers between the tubes, and brazing the whole assembly to bond the parts at each joint.

5. The invention as defined in claim 4 wherein tabs are also formed on the header plate by stamping and are used to mechanically secure the two plates together prior to brazing.

6. The invention as defined in claim 4 wherein the header plate and the tank plate are stamped from the same sheet stock.

7. The invention as defined in claim 4 wherein the header plate and the tank plate are stamped from braze clad aluminum sheet stock.

* * * * *